US005887276A

United States Patent [19]

Lee

[11] Patent Number: 5,887,276

[45] Date of Patent: Mar. 30, 1999

[54] COOLING CAP

[76] Inventor: Song Hwi Lee, 8-206 Han Yang Apt. 490, Apku Jong-dong, Kangnam-Ku, Seoul 135-112, Rep. of Korea

[21] Appl. No.: 975,442

[22] Filed: Nov. 21, 1997

[51] Int. Cl.[6] ..... G06F 12/00

[52] U.S. Cl. ..... 2/7; 2/195.1; 2/200.1

[58] Field of Search ..... 2/7, 195.1, 200.1, 2/DIG. 1, 181, 209.5

[56] References Cited

U.S. PATENT DOCUMENTS 5,630,230 5/1997 Fugino et al. ..... 2/200.1

*Primary Examiner*—Diana L. Biefeld

*Attorney, Agent, or Firm*—Jerry Cohen; Christine M. Kuta

[57] ABSTRACT

A cooling cap (1) made up with knitted net fabric of polyester yarn comprises an outer open-meshed fabric (3) for covering the front half part of the hemispheric part of the cap to receive the human head, an inner fine linen fabric (4) for lining the outer open-meshed fabric, a water absorbent fiber layer (5) for bearing water or absorbing sweat, and a plurality of eyelets or loopholes (6). The head is cooled owing to the vaporization of the water borne in the water absorbent fiber layer by absorbing the heat.

4 Claims, 1 Drawing Sheet

COOLING CAP

BACKGROUND OF THE INVENTION

The present invention concens a summer cap made of open-meshed fabric of polyester yarn. There have been developed many varieties of the cap; one of which is the summer cap having a large visor to shield the summer daylight or made of open-meshed fabric to make ventilation. However, such summer cap has no positive means to effectively cool the head of a person working in the field, so that the worker must suffer the heat of the sun or other high temperature environment (e.g. steel mill) or where the user generates heat by exertion, e.g. exercise, manual labor.

SUMMARY OF THE INVENTION

It is an object of the present invention to provide a cooling cap) made up with knitted net fabric of polyester yarn with a positive means to cool the wearer's head.

According, to the present invention, a cooling cap made up with knitted net fabric of polyester yarn comprises an outer open-meshed fabric for covering the front half part of the hemispheric part of the cap to receive the human head, an inner fine linen fabric for lining the outer open-meshed fabric, a water absorbent fiber layer for bearing water or absorbing sweat, and a plurality of eyelets or loopholes Thus, when the user puts on the cap after soaking the water absorbent fiber layer in water, the water borne in the water absorbent fiber layer is vaporized by absorbing the heat produced from the heat of the user working or exercising and the heat of daylight and by ventilation, so as to cool the head.

The present invention will now be described more specifically with reference to the drawings attached only by way of example.

BRIEF DESCRIPTION OF THE ATTACHED DRAWINGS

FIG. 1 is a partly cut perspective view for illustrating a cooling cap according to the present invention; and FIG. 2 is a cross-sectional view of FIG. 1 for illustrating the structure of the inventive cooling cap.

DETAILED DESCRIPTION OF PREFERRED EMBODIMENTS

Figure 1:
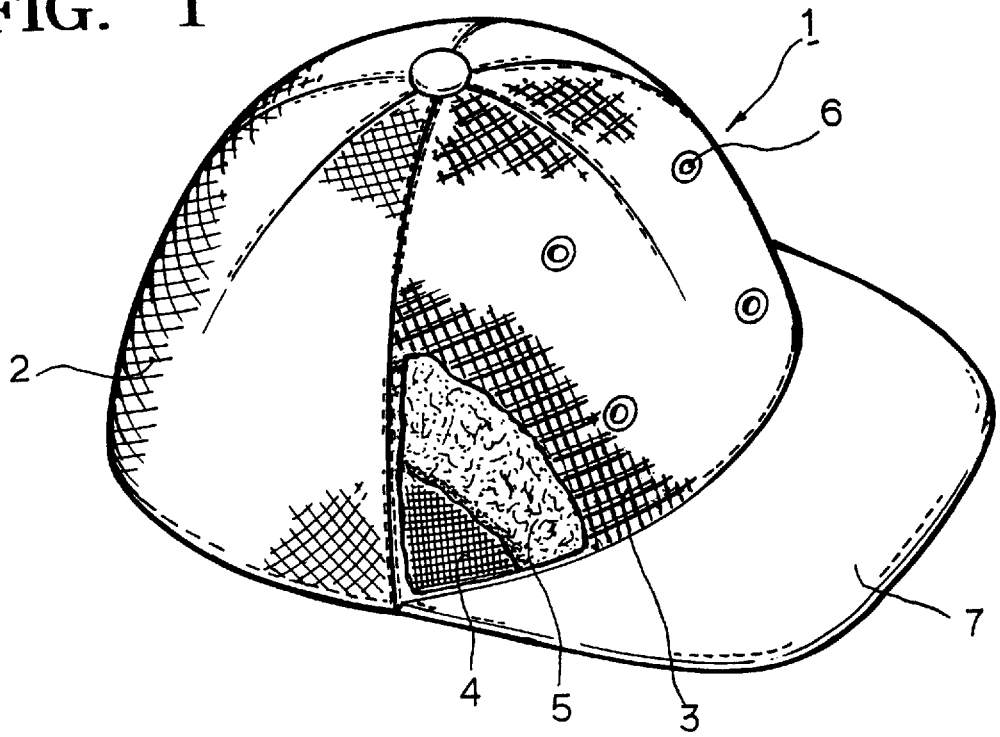
Figure 2:
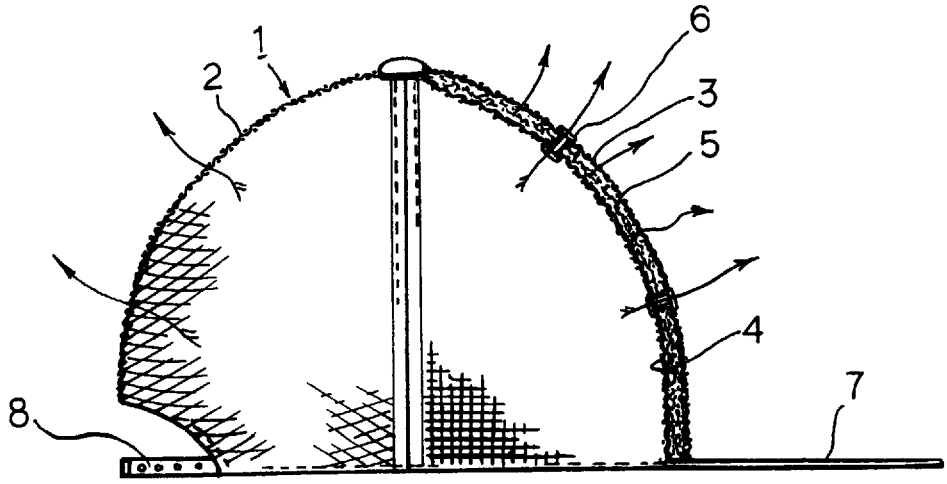

Referring to FIGS. 1 and 2, there is schematically shown a cooling cap (1) made up with knitted net fabric of polyester yarn fabric 2 which includes an outer open-meshed fabric 3 for covering the front half part of the hemispheric part of the cap 1 to receive the human head, an inner fine linen fabric 4 for lining the outer open-meshed fabric, a water absorbent fiber layer 5 for bearing water or absorbing sweat and: a plurality of eyelets or loopholes 6. Reference numerals 7 and 8 indicate respectively the viser and adjustment band of the cap, both of conventional form.

In use, when the user puts on the cap 1 after soaking the water absorbent fiber layer 5 in water or other liquid and shaking it lightly, the water borne therein by capillarity is gradually vaporized by absorbing the heat produced from the head and the heat of daylight and by ventilation through the open-meshed fabric 3 and the loopholes 6, so as to cool the head. In addition, the inner fine linen fabric 4 serves to prevent the water borne in the water absorbent fiber layer 5 from flowing out along the face. The absorbent fiber layer 5 preferably contains an antibacterial substance, and thus prevents odors.

Moreover, the water absorbent fiber layer 5 also absorbs the sweat excreted from the skin of the head, which is consequently vaporized, thus serving to cool the head and therefore to provide bodily comfort. Hence, the inventive cooling cap has versatility in various human activities such as walking, exercising, working, sporting, etc.

Although the present invention has been described in reference to the specific embodiments accompanying the attached drawings, it will be readily apparent to those skilled in the art that various modifications and changes may be made thereto without departing from the spirit of the present invention.

What is claimed is:

1. A cooling cap made up with knitted net fabric of polyester yarn, comprising:

an outer open mesh fabric of polyester yarn for covering a front half part of a hemispheric part of said cap to receive the human head;

an inner fine linen fabric for lining said outer open mesh fabric;

a water absorbent fiber layer for bearing water or absorbing sweat and giving up water vapor to the ambient environment through heating by a wearer and/or external source, whereby the wearer's head may be cooled owing to the vaporization of the water borne in said water absorbent fiber layer.

2. The cap of claim 1 wherein the cap also comprises a plurality of eyelets or loopholes that contribute to its cooling action.

3. The cap of claim 1 wherein the absorbent layer is provided with an antibacterial additive.

4. The cap of claim 1 wherein the cap also comprises a plurality of eyelets or loopholes that contribute to its cooling action, and said fabrics are provided with an antibacterial additive.

* * * * *